US011680302B2

(12) United States Patent
Fujimura et al.

(10) Patent No.: US 11,680,302 B2
(45) Date of Patent: Jun. 20, 2023

(54) GRAIN-ORIENTED ELECTRICAL STEEL SHEET AND HOT-ROLLED STEEL SHEET FOR GRAIN-ORIENTED ELECTRICAL STEEL SHEET

(71) Applicant: NIPPON STEEL & SUMITOMO METAL CORPORATION, Tokyo (JP)

(72) Inventors: Hiroshi Fujimura, Tokyo (JP); Fumiaki Takahashi, Tokyo (JP); Takashi Kataoka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 341 days.

(21) Appl. No.: 15/760,143

(22) PCT Filed: Sep. 28, 2016

(86) PCT No.: PCT/JP2016/078671
§ 371 (c)(1),
(2) Date: Mar. 14, 2018

(87) PCT Pub. No.: WO2017/057487
PCT Pub. Date: Apr. 6, 2017

(65) Prior Publication Data

US 2018/0258508 A1 Sep. 13, 2018

(30) Foreign Application Priority Data

Sep. 28, 2015 (JP) ..... JP2015-189306

(51) Int. Cl.
*C21D 9/46* (2006.01)
*C22C 38/60* (2006.01)
(Continued)

(52) U.S. Cl.
CPC ..... *C21D 9/46* (2013.01); *C21D 6/005* (2013.01); *C21D 6/008* (2013.01); *C21D 8/12* (2013.01);
(Continued)

(58) Field of Classification Search
CPC ..... C21D 9/46; C21D 8/12; C21D 8/1222; C21D 8/1233; C21D 8/1255;
(Continued)

(56) References Cited

U.S. PATENT DOCUMENTS 5,039,359 A 8/1991 Yoshitomi et al.
5,667,598 A 9/1997 Ozaki et al.
(Continued)

FOREIGN PATENT DOCUMENTS

EP 0125653 A1 11/1984
JP 58-217630 A 12/1983
(Continued)

OTHER PUBLICATIONS

Extended European Search Report, dated Jun. 3, 2019, for European Application No. 16851658.1.
(Continued)

*Primary Examiner* — Alexandra M Moore
*Assistant Examiner* — Austin Pollock
(74) *Attorney, Agent, or Firm* — Birch, Stewart, Kolasch & Birch, LLP

(57) ABSTRACT

A grain-oriented electrical steel sheet includes: a chemical composition represented by, in mass %, Si: 2.0% to 5.0%, Mn: 0.03% to 0.12%, Cu: 0.10% to 1.00%, sb or Sn, or both thereof: 0.000% to 0.3% in total, Cr: 0% to 0.3%, P: 0% to 0.5%, Ni: 0% to 1%, and the balance: Fe and impurities, in which an L-direction average diameter of crystal grains observed on a surface of the steel sheet in an L direction parallel to a rolling direction is equal to or more than 3.0
(Continued)

0.4%Cu times a C-direction average diameter in a C direction vertical to the rolling direction.

4 Claims, 1 Drawing Sheet

(51) Int. Cl.

| | |
|---|---|
| ***C21D 8/12*** | (2006.01) |
| ***H01F 1/16*** | (2006.01) |
| ***C22C 38/00*** | (2006.01) |
| ***C21D 6/00*** | (2006.01) |
| ***C22C 38/02*** | (2006.01) |
| ***C22C 38/04*** | (2006.01) |
| ***C22C 38/16*** | (2006.01) |

(52) U.S. Cl.
CPC ..... *C21D 8/1222* (2013.01); *C21D 8/1233* (2013.01); *C21D 8/1255* (2013.01); *C21D 8/1261* (2013.01); *C21D 8/1272* (2013.01); *C21D 8/1283* (2013.01); *C22C 38/00* (2013.01); *C22C 38/001* (2013.01); *C22C 38/002* (2013.01); *C22C 38/02* (2013.01); *C22C 38/04* (2013.01); *C22C 38/16* (2013.01); *C22C 38/60* (2013.01); *H01F 1/16* (2013.01)

(58) Field of Classification Search
CPC .. C21D 8/1261; C21D 8/1272; C21D 8/1283; C21D 2201/05; C22C 38/00; C22C 38/001; C22C 38/002; C22C 38/02; C22C 38/04; C22C 38/16; C22C 38/60
See application file for complete search history.

(56) References Cited

U.S. PATENT DOCUMENTS

| | | | | |
|---|---|---|---|---|
| 5,858,126 | A * | 1/1999 | Takashima | C21D 8/12 148/308 |
| 7,942,982 | B2 | 5/2011 | Kubo et al. | |
| 2003/0034092 | A1* | 2/2003 | Takashima | C21D 8/1255 148/111 |
| 2012/0018049 | A1 | 1/2012 | Fortunati et al. | |
| 2012/0222777 | A1 | 9/2012 | Fortunati et al. | |
| 2012/0298265 | A1 | 11/2012 | Sadahiro | |
| 2016/0273064 | A1 | 9/2016 | Kataoka et al. | |

FOREIGN PATENT DOCUMENTS

| | | | | |
|---|---|---|---|---|
| JP | 59-193216 | A | | 11/1984 |
| JP | 61-12822 | A | | 1/1986 |
| JP | 2-8327 | A | | 1/1990 |
| JP | 2-274815 | A | | 11/1990 |
| JP | 6-73509 | A | | 3/1994 |
| JP | 6-88171 | A | | 3/1994 |
| JP | H0673509 | A | * | 8/1994 |
| JP | 8-100216 | A | | 4/1996 |
| JP | 8-157964 | A | | 6/1996 |
| JP | 8-225842 | A | | 9/1996 |
| JP | 9-316537 | A | | 12/1997 |
| JP | 10-102149 | A | | 4/1998 |
| JP | H028327 | | * | 7/1998 |
| JP | 2000-109931 | A | | 4/2000 |
| JP | 2003-193132 | A | | 7/2003 |
| JP | 2005-95968 | A | | 4/2005 |
| JP | 2009-235574 | A | | 10/2009 |
| JP | 2011-190485 | A | | 9/2011 |
| JP | 2013-512332 | A | | 4/2013 |
| WO | WO 98/08987 | A1 | | 3/1998 |
| WO | WO 98/46801 | A1 | | 10/1998 |
| WO | WO 2014/168136 | A1 | | 10/2014 |

OTHER PUBLICATIONS

Japanese Office Action, dated Oct. 16, 2018 for corresponding Japanese Application No. 2017-543506, with an English machine translation.

Notification of Transmittal of Translation of the International Preliminary Report on Patentability, International Preliminary Report on Patentability, Written Opinion of the International Searching Authority, dated Apr. 12, 2018, for PCT/JP2016/078671 (Forms PCT/IB/338, PCT/IB/373 and PCT/ISA/237).

International Search Report for PCT/JP2016/078671 (PCT/ISA/210) dated Dec. 13, 2016.

Written Opinion of the International Searching Authority for PCT/JP2016/078671 (PCT/ISA/237) dated Dec. 13, 2016.

* cited by examiner 0.4%Cu 0.01%Cu

GRAIN-ORIENTED ELECTRICAL STEEL SHEET AND HOT-ROLLED STEEL SHEET FOR GRAIN-ORIENTED ELECTRICAL STEEL SHEET

TECHNICAL FIELD

The present invention relates to a grain-oriented electrical steel sheet, a hot-rolled steel sheet for a grain-oriented electrical steel sheet, and the like.

BACKGROUND ART

A grain-oriented electrical steel sheet widely used for, for example, an iron core material of a transformer, and the like is required to have a property in which crystal orientations are aligned in one direction in order to obtain an excellent magnetic property. Therefore, in a conventional manufacturing method, a slab containing inhibitor components such as S and Se is heated to a high temperature of 1300° C. or more before hot rolling. However, in the case of the slab heating temperature being high, the temperature is likely to fluctuate largely at a leading end and a rear end of the slab, and thus it is difficult to uniformize solution of MnS and fine precipitation in hot rolling over the entire length of the slab. Therefore, failure of magnetic property caused by inhibitor deficiency occurs at a leading end and a rear end of a steel sheet coil obtained from the slab, and the magnetic property does not become homogeneous over the entire length of the steel sheet coil in some cases. Although various techniques have been proposed so far, it is difficult to obtain a homogeneous magnetic property over the entire length of the steel sheet coil.

CITATION LIST

Patent Literature

Patent Literature 1: Japanese Laid-open Patent Publication No. 58-217630

Patent Literature 2: Japanese Laid-open Patent Publication No. 61-12822

Patent Literature 3: Japanese Laid-open Patent Publication No. 06-88171

Patent Literature 4: Japanese Laid-open Patent Publication No. 08-225842

Patent Literature 5: Japanese Laid-open Patent Publication No. 09-316537

Patent Literature 6: Japanese Laid-open Patent Publication No. 2011-190485

Patent Literature 7: Japanese Laid-open Patent Publication No. 08-100216

Patent Literature 8: Japanese Laid-open Patent Publication No. 59-193216

Patent Literature 9: Japanese Laid-open Patent Publication No. 09-316537

Patent Literature 10: Japanese Laid-open Patent Publication No. 08-157964

SUMMARY OF INVENTION

Technical Problem

An object of the present invention is to provide a low-core loss grain-oriented electrical steel sheet that enables a good and less varied magnetic property over an entire length of a steel sheet coil, a hot-rolled steel sheet for a grain-oriented electrical steel sheet, and the like.

Solution to Problem

The present inventors conducted earnest examinations so as to solve the above-described problems. As a result, it became clear that in a manufacturing method of a grain-oriented electrical steel sheet that requires high-temperature slab heating, use of a molten steel containing Cu makes it possible to suppress temperature dependence of solution of MnS and fine precipitation in hot rolling. However, it also became clear that when a Cu sulfide is formed, property deterioration becomes likely to be caused at a leading end and a rear end of a steel sheet coil because precipitation behavior of the Cu sulfide is unstable.

Thus, the present inventors further conducted earnest examinations so as to suppress formation of the Cu sulfide. As a result, it became clear that selectivity between formation of a Mn sulfide and formation of a Cu sulfide significantly depends on a thermal history, in particular, ranging from on and after rough rolling of hot rolling to before start of cold rolling. Then, it became clear that in a molten steel containing 0.10% or more of Cu, as long as generation of the Cu sulfide is suppressed at a time when a hot-rolled steel sheet is manufactured, MnS has stably precipitated. Therefore, it was found out that it is possible to avoid a decrease in strength of inhibitors of MnS and AlN during finish annealing, sharpen secondary recrystallization in the Goss orientation, and avoid also material variability in a coil caused by a variation in manufacturing conditions at ends of the coil.

As a result of further repeated earnest examinations based on such findings, the present inventors have reached the following various aspects of the invention.

(1)

A grain-oriented electrical steel sheet, including:

a chemical composition represented by, in mass %,

Si: 2.0% to 5.0%,

Mn: 0.03% to 0.12%,

Cu: 0.10% to 1.00%,

Sb or Sn, or both thereof: 0.000% to 0.3% in total,

Cr: 0% to 0.3%,

P: 0% to 0.5%,

Ni: 0% to 1%, and the balance: Fe and impurities, wherein an L-direction average diameter of crystal grains observed on an surface of the steel sheet in an L direction parallel to a rolling direction is equal to or more than 3.0 times a C-direction average diameter in a C direction vertical to the rolling direction.

(2)

The grain-oriented electrical steel sheet according to (1), wherein the L-direction average diameter is equal to or more than 3.5 times the C-direction average diameter.

(3)

A hot-rolled steel sheet for a grain-oriented electrical steel sheet, including:

a chemical composition represented by, in mass %,

C: 0.015% to 0.10%,

Si: 2.0% to 5.0%,

Mn: 0.03% to 0.12%, acid-soluble Al: 0.010% to 0.065%,

N: 0.0040% to 0.0100%,

Cu: 0.10% to 1.00%,

Cr: 0% to 0.3%,

P: 0% to 0.5%,

Ni: 0% to 1%,

S or Se, or both thereof: 0.005% to 0.050% in total,

Sb or Sn, or both thereof: 0.000% to 0.3% in total,

Y, Te, La, Ce, Nd, Hf, Ta, Pb, or Bi, or any combination thereof: 0.0000% to 0.01% in total, and the balance: Fe and impurities, wherein MnS or MnSe, or both thereof having a circle-equivalent diameter of 50 nm or less are dispersed and $Cu_2S$ is not substantially precipitated.

(4)

The hot-rolled steel sheet for a grain-oriented electrical steel sheet according to (3), wherein the chemical composition satisfies: at least one of Sb or Sn, or both thereof: 0.003% to 0.3% in total and Y, Te, La, Ce, Nd, Hf, Ta, Pb, or Bi, or any combination thereof: 0.0005% to 0.01% in total.

(5)

A manufacturing method of a grain-oriented electrical steel sheet, including:

obtaining a slab by continuous casting a molten steel;

obtaining a hot-rolled steel sheet by hot rolling the slab heated in a temperature zone of 1300° C. to 1490° C.;

coiling the hot-rolled steel sheet in a temperature zone of 600° C. or less;

annealing the hot-rolled steel sheet;

after the hot-rolled sheet annealing, obtaining a cold-rolled steel sheet by cold rolling;

decarburization annealing the cold-rolled steel sheet; and after the decarburization annealing, coating an annealing separating agent containing MgO and finish annealing, wherein the hot rolling includes rough rolling with a finishing temperature of 1200° C. or less and finish rolling with a start temperature of 1000° C. or more and a finishing temperature of 950° C. to 1100° C., in the hot rolling, the finish rolling is started within 300 seconds after start of the rough rolling, cooling at a cooling rate of 50° C./second or more is started within 10 seconds after finish of the finish rolling, a holding temperature of the hot-rolled sheet annealing is 950° C. to (Tf+100)° C. when the finishing temperature of the finish rolling is Tf, and the molten steel includes a chemical composition represented by, in mass %, C: 0.015% to 0.10%, Si: 2.0% to 5.0%, Mn: 0.03% to 0.12%, acid-soluble Al: 0.010% to 0.065%, N: 0.0040% to 0.0100%, Cu: 0.10% to 1.00%, Cr: 0% to 0.3%, P: 0% to 0.5%, Ni: 0% to 1%, S or Se, or both thereof: 0.005% to 0.050% in total, Sb or Sn, or both thereof: 0.000% to 0.3% in total, Y, Te, La, Ce, Nd, Hf, Ta, Pb, or Bi, or any combination thereof: 0.0000% to 0.01% in total, and the balance: Fe and impurities.

(6)

The manufacturing method of the grain-oriented electrical steel sheet according to (5), wherein the casting includes magnetically stirring the molten steel in a region where a thickness of one-side solidified shell is equal to or more than 25% of a thickness of the slab.

(7)

The manufacturing method of the grain-oriented electrical steel sheet according to (5) or (6), wherein the chemical composition satisfies: at least one of Sb or Sn, or both thereof: 0.003% to 0.3% in total and Y, Te, La, Ce, Nd, Hf, Ta, Pb, or Bi, or any combination thereof: 0.0005% to 0.01% in total.

(8)

A manufacturing method of a hot-rolled steel sheet for a grain-oriented electrical steel sheet, including:

obtaining a slab by continuous casting a molten steel;

obtaining a hot-rolled steel sheet by hot rolling the slab heated in a temperature zone of 1300° C. to 1490° C.; and coiling the hot-rolled steel sheet in a temperature zone of 600° C. or less, wherein the hot rolling comprises rough rolling with a finishing temperature of 1200° C. or less and finish rolling with a start temperature of 1000° C. or more and a finishing temperature of 950° C. to 1100° C., in the hot rolling, the finish rolling is started within 300 seconds after start of the rough rolling, cooling at a cooling rate of 50° C./second or more is started within 10 seconds after finish of the finish rolling, and the molten steel includes a chemical composition represented by, in mass %, C: 0.015% to 0.10%, Si: 2.0% to 5.0%, Mn: 0.03% to 0.12%, acid-soluble Al: 0.010% to 0.065%, N: 0.0040% to 0.0100%, Cu: 0.10% to 1.00%, Cr: 0% to 0.3%, P: 0% to 0.5%, Ni: 0% to 1%, S or Se, or both thereof: 0.005% to 0.050% in total, Sb or Sn, or both thereof: 0.000% to 0.3% in total, Y, Te, La, Ce, Nd, Hf, Ta, Pb, or Bi, or any combination thereof: 0.0000% to 0.01% in total, and the balance: Fe and impurities.

(9)

The manufacturing method of the hot-rolled steel sheet for a grain-oriented electrical steel sheet according to (8), wherein the casting includes magnetically stirring the molten steel in a region where a thickness of one-side solidified shell is equal to or more than 25% of a thickness of the slab.

(10)

The manufacturing method of the hot-rolled steel sheet for a grain-oriented electrical steel sheet according to (8) or (9), wherein the chemical composition satisfies: at least one of Sb or Sn, or both thereof: 0.003% to 0.3% in total and Y, Te, La, Ce, Nd, Hf, Ta, Pb, or Bi, or any combination thereof: 0.0005% to 0.01% in total.

Advantageous Effects of Invention

According to the present invention, it is possible to uniformize solution of precipitates functioning as an inhibitor and fine precipitation in hot rolling over an entire length of a slab, and obtain a low core loss, a less varied and good magnetic property over an entire length of a coil.

DESCRIPTION OF EMBODIMENTS

Figure 1:
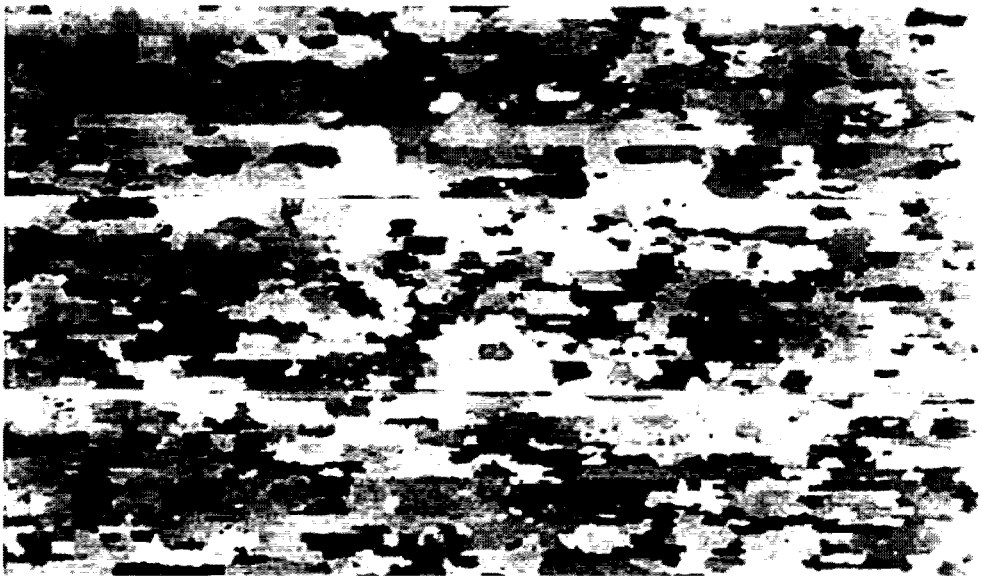
FIG. 1 is an image showing a crystal structure in the case of the Cu content being 0.4%.

Hereinafter, there will be explained embodiments of the present invention in detail.

First, there will be explained chemical compositions of a hot-rolled steel sheet for a grain-oriented electrical steel sheet and a molten steel used for its manufacture according to the embodiments of the present invention. Although their details will be described later, the hot-rolled steel sheet for a grain-oriented electrical steel sheet according to the embodiment of the present invention is manufactured by going through continuous casting of molten steel, hot rolling, and the like. Thus, the chemical compositions of the hot-rolled steel sheet for a grain-oriented electrical steel sheet and the molten steel consider not only properties of the hot-rolled steel sheet, but also these treatments. In the following explanation, "%" being the unit of the content of each element contained in the hot-rolled steel sheet for a grain-oriented electrical steel sheet or the molten steel means "mass %" unless otherwise noted. The hot-rolled steel sheet for a grain-oriented electrical steel sheet according to this embodiment includes a chemical composition represented by C: 0.015% to 0.10%, Si: 2.0% to 5.0%, Mn: 0.03% to 0.12%, acid-soluble Al: 0.010% to 0.065%, N: 0.0040% to 0.0100%, Cu: 0.10% to 1.00%, Cr: 0% to 0.3%, P: 0% to 0.5%, Ni: 0% to 1%, S or Se, or both thereof: 0.005% to 0.050% in total, Sb or Sn, or both thereof: 0.000% to 0.3% in total, Y, Te, La, Ce, Nd, Hf, Ta, Pb, or Bi or any combination thereof: 0.0000% to 0.01% in total, and the balance: Fe and impurities. Examples of the impurities include ones contained in raw materials such as ore and scrap and ones contained in manufacturing steps.

(C: 0.015% to 0.10%)

C stabilizes secondary recrystallization. When the C content is less than 0.015%, the secondary recrystallization becomes unstable. Thus, the C content is 0.015% or more. For further stabilization of the secondary recrystallization, the C content is preferably 0.04% or more. When the C content is greater than 0.10%, the time required for decarburization annealing is prolonged to be disadvantageous economically. Thus, the C content is 0.10% or less, and preferably 0.09% or less.

(Si: 2.0% to 5.0%)

As the Si content is larger, resistivity more increases to reduce an eddy loss of a product. When the Si content is less than 2.0%, the eddy loss increases. Thus, the Si content is 2.0% or more. As the Si content is larger, cracking is more likely to occur in cold rolling, and when the Si content is greater than 5.0%, cold rolling becomes difficult. Thus, the Si content is 5.0% or less. For a further reduction in core loss of the product, the Si content is preferably 3.0% or more. For prevention of a decrease in yield caused by cracking during manufacture, the Si content is preferably 4.0% or less.

(Mn: 0.03% to 0.12%)

Mn forms precipitates with S, Se to strengthen inhibitors. When the Mn content is less than 0.03%, an effect of the above is small. Thus, the Mn content is 0.03% or more. When the Mn content is greater than 0.12%, insoluble Mn is generated in slab heating, to then make it impossible to precipitate MnS or MnSe uniformly and finely in subsequent hot rolling. Thus, the Mn content is 0.12% or less.

(Acid-Soluble Al: 0.010% to 0.065%)

Al forms AlN to work as an inhibitor. When the Al content is less than 0.010%, an effect of the above is not exhibited. Thus, the Al content is 0.010% or more. For further stabilization of the secondary recrystallization, the Al content is preferably 0.020% or more. When the Al content is greater than 0.065%, Al no longer works effectively as an inhibitor. Thus, the Al content is 0.065% or less. For further stabilization of the secondary recrystallization, the Al content is preferably 0.040% or less.

(N: 0.0040% to 0.0100%)

N forms AlN to work as an inhibitor. When the N content is less than 0.0040%, an effect of the above is not exhibited. Thus, the N content is 0.0040% or more. When the N content is greater than 0.0100%, surface flaws called blisters occur. Thus, the N content is 0.0100% or less. For further stabilization of the secondary recrystallization, the N content is preferably 0.0060% or more.

(Cu: 0.10% to 1.00%)

Cu reduces temperature dependence of solution of MnS and MnSe in slab heating and precipitation of MnS and MnSe in hot rolling to make MnS and MnSe precipitate uniformly and finely. When the Cu content is less than 0.10%, an effect of the above is small. Thus, the Cu content is 0.10% or more. For more securely obtaining this effect, the Cu content is preferably greater than 0.30%. When the Cu content is greater than 1.00%, edge cracking becomes likely to occur at the time of hot rolling and it is not economical. Thus, the Cu content is 1.00% or less. For more secure suppression of the edge cracking, the Cu content is preferably 0.80% or less.

(S or Se, or Both Thereof: 0.005% to 0.050% in Total)

S and Se have an effect to strengthen inhibitors and improve the magnetic property. When the content of S or Se or both is less than 0.005% in total, the inhibitors are weak and the magnetic property deteriorates. Thus, the content of S or Se, or both thereof is 0.005% or more in total. For further stabilization of the secondary recrystallization, the content of S or Se, or both thereof is preferably 0.020% or more in total. When the content of S or Se, or both thereof is greater than 0.050% in total, edge cracking becomes likely to occur at the time of hot rolling. Thus, the content of S or Se, or both thereof is 0.050% or less in total. For further stabilization of the secondary recrystallization, the content of S or Se, or both thereof is preferably 0.040% or less in total.

Sb, Sn, Y, Te, La, Ce, Nd, Hf, Ta, Pb, and Bi are not essential elements, but are arbitrary elements that may be appropriately contained, up to a predetermined amount as a limit, in the hot-rolled sheet for a grain-oriented electrical steel sheet.

(Sb or Sn, or Both Thereof: 0.000% to 0.3% in Total)

Sb and Sn strengthen inhibitors. Thus, Sb or Sn may be contained. For sufficiently obtaining a function effect of the above, the content of Sb or Sn, or both thereof is preferably 0.003% or more in total. When the content of Sb or Sn, or both thereof is greater than 0.3% in total, it is possible to obtain the function effect, but it is not economical. Thus, the content of Sb or Sn, or both thereof is 0.3% or less in total.

(Y, Te, La, Ce, Nd, Hf, Ta, Pb, or Bi or Any Combination Thereof: 0.0000% to 0.01% in Total)

Y, Te, La, Ce, Nd, Hf, Ta, Pb, and Bi strengthen inhibitors. Thus, Y, Te, La, Ce, Nd, Hf, Ta, Pb, or Bi or any combination thereof may be contained. For sufficiently obtaining a function effect of the above, the content of Y, Te, La, Ce, Nd, Hf, Ta, Pb, or Bi or any combination thereof is preferably 0.0005% or more in total. For further stabilization of the secondary recrystallization, the content of Y, Te, La, Ce, Nd, Hf, Ta, Pb, or Bi or any combination thereof is more preferably 0.0010% or more in total. When the content of Y, Te, La, Ce, Nd, Hf, Ta, Pb, or Bi or any combination thereof is greater than 0.01% in total, it is possible to obtain the function effect, but it is not economical. Thus, the content of Y, Te, La, Ce, Nd, Hf, Ta, Pb, or Bi or any combination thereof is 0.01% or less in total.

(Others)

The hot-rolled steel sheet for a grain-oriented electrical steel sheet according to this embodiment may further contain Cr: 0% to 0.3%, P: 0% to 0.5%, and Ni: 0% to 1% according to a well-known purpose.

In the hot-rolled steel sheet for a grain-oriented electrical steel sheet according to the embodiment of the present invention, MnS or MnSe, or both thereof having a circle-equivalent diameter of 50 nm or less are dispersed, and $Cu_2S$ is not substantially precipitated. $Cu_2S$ is a thermally unstable precipitate as compared to MnS and MnSe, and hardly has an effect as an inhibitor. Therefore, when a hot-rolled steel sheet is manufactured under the condition of $Cu_2S$ not being generated, dispersion states of MnS and MnSe rather improve, and the magnetic property of the product improves. A state where these precipitates exist is confirmed by a transmission electron microscope (TEM) with a thin-film sample formed by a focused ion beam (FIB). When compositions of fine precipitates dispersed in a steel are identified by energy dispersive X-ray spectroscopy (EDS), not only components composing the precipitates, but also components contained in a parent phase are detected. Thus, it is set in the present invention that 10 pieces of sulfide and Se compound each having a diameter of 30 nm to 50 nm are subjected to an EDS analysis and in the case of the Cu content being 1% or less resulting from a quantitative analysis including the parent phase, it is determined that $Cu_2S$ is not substantially precipitated. When the sulfides or Se compounds are not spherical, a circle-equivalent diameter D is the diameter of the precipitate. An area S of the precipitate is measured by TEM observation, and the circle-equivalent diameter D can be found by "$S=\pi D^2/4$."

Next, there will be explained the chemical composition of the grain-oriented electrical steel sheet according to the embodiment of the present invention. Although its detail will be explained later, the grain-oriented electrical steel sheet according to the embodiment of the present invention is manufactured by going through casting of molten steel, hot rolling, hot-rolled sheet annealing, cold rolling, coating of annealing separating agent, finish annealing, and the like. Thus, the chemical composition of the grain-oriented electrical steel sheet considers not only properties of the grain-oriented electrical steel sheet, but also these treatments. In the following explanation, "%" being the unit of the content of each element contained in the grain-oriented electrical steel sheet means "mass %" unless otherwise noted. The grain-oriented electrical steel sheet according to this embodiment includes a chemical composition represented by Si: 2.0% to 5.0%, Mn: 0.03% to 0.12%, Cu: 0.10% to 1.00%, Sb or Sn, or both thereof: 0.000% to 0.3% in total, Cr: 0% to 0.3%, P: 0% to 0.5%, Ni: 0% to 1% and the balance: Fe and impurities. Examples of the impurities include ones contained in raw materials such as ore and scrap and ones contained in manufacturing steps.

(Si: 2.0% to 5.0%)

As the Si content is larger, resistivity more increases to reduce an eddy loss of the product. When the Si content is less than 2.0%, the eddy loss increases. Thus, the Si content is 2.0% or more. As the Si content is larger, cracking is more likely to occur in cold rolling, and when the Si content is greater than 5.0%, cold rolling becomes difficult. Thus, the Si content is 5.0% or less. For a further reduction in core loss of the product, the Si content is preferably 3.0% or more.

(Mn: 0.03% to 0.12%)

Mn forms precipitates with S or Se to strengthen inhibitors. When the Mn content is less than 0.03%, an effect of the above is small. Thus, the Mn content is 0.03% or more. When the Mn content is greater than 0.12%, insoluble Mn is generated in slab heating, to then make it impossible to precipitate MnS or MnSe uniformly and finely in subsequent hot rolling. Thus, the Mn content is 0.12% or less.

(Cu: 0.10% to 1.00%)

Cu reduces temperature dependence of solution of MnS and MnSe in a hot rolling temperature zone to make MnS and MnSe precipitate uniformly and finely. When the Cu content is less than 0.10%, an effect of the above is small. Thus, the Cu content is 0.10% or more. For more securely obtaining this effect, the Cu content is preferably greater than 0.30%. When the Cu content is greater than 1.00%, edge cracking becomes likely to occur at the time of hot rolling and it is not economical. Thus, the Cu content is 1.00% or less. For more secure suppression of the edge cracking, the Cu content is preferably 0.80% or less.

Sb and Sn are not essential elements, but are arbitrary elements that may be appropriately contained, up to a predetermined amount as a limit, in the grain-oriented electrical steel sheet.

(Sb or Sn, or Both Thereof: 0.000% to 0.3% in Total)

Sb and Sn strengthen inhibitors. Thus, Sb or Sn may be contained. For sufficiently obtaining a function effect of the above, the content of Sb or Sn, or both thereof is preferably 0.003% or more in total. When the content of Sb or Sn, or both thereof is greater than 0.3% in total, it is possible to obtain the function effect, but it is not economical. Thus, the content of Sb or Sn, or both thereof is set to 0.3% or less in total.

(Others)

The grain-oriented electrical steel sheet according to this embodiment may further contain Cr: 0% to 0.3%, P: 0% to 0.5%, and Ni: 0% to 1% according to a well-known purpose.

C, acid-soluble Al, N, Cr, P, Ni, S, and Se are utilized for controlling crystal orientations in a Goss texture which accumulates in the {110}<001> orientation, and do not have to be contained in the grain-oriented electrical steel sheet. Although details will be explained later, these elements are to be discharged outside a system in purification annealing included in finish annealing. Decreases in concentration of C, N, S, acid-soluble Al, and Se, in particular, are significant and the concentration becomes 50 ppm or less. Under a normal purification annealing condition, the concentration becomes 9 ppm or less and further 6 ppm or less, and when the purification annealing is performed sufficiently, the concentration reaches down to a level that is not detectable by general analysis (1 ppm or less). Thus, even when C, N, S, acid-soluble Al, and Se remain in the grain-oriented electrical steel sheet, they are to be contained as impurities.

In the grain-oriented electrical steel sheet according to the embodiment of the present invention, an L-direction average diameter of crystal grains observed on an surface of the steel sheet in an L direction parallel to a rolling direction is equal to or more than 3.0 times a C-direction average diameter in a C direction vertical to the rolling direction. In the following explanation, a ratio of the L-direction average diameter to the C-direction average diameter (L-direction average diameter/C-direction average diameter) is sometimes referred to as a "grain diameter ratio." The crystal structure of the grain-oriented electrical steel sheet of this embodiment is a characteristic crystal structure ascribable to a unique inhibitor control. A mechanism of forming the structure is not clear, but it is probably inferred that the formation of the structure correlates with dispersion states of MnS and MnSe being inhibitors. When the grain diameter ratio becomes 3.0 or more, a magnetic resistance at a crystal grain boundary decreases and a magnetic domain width decreases, and thus the magnetic property improves. Thus, the grain diameter ratio of crystal grains observed on the surface of the steel sheet is 3.0 or more, and preferably 3.5 or more.

Next, there will be explained a manufacturing method of the hot-rolled steel sheet for a grain-oriented electrical steel sheet according to an embodiment of the present invention. In the manufacturing method of the hot-rolled steel sheet for a grain-oriented electrical steel sheet according to this embodiment, continuous casting of molten steel, hot rolling, and the like are performed.

First, in the continuous casting of the molten steel and the hot rolling, the continuous casting of the molten steel used for manufacture of the above-described hot-rolled steel sheet is performed to fabricate a slab, and the slab is heated and hot rolled.

In the continuous casting, the molten steel is preferably magnetically stirred in a region where a one-side solidified shell thickness becomes 25% or more of a thickness of the slab. This is because when a ratio of the one-side solidified shell thickness to the slab thickness is less than 25%, $Cu_2S$ is likely to precipitate and it may be hardly possible to obtain an effect of improving the magnetic property. Thus, the ratio of the one-side solidified shell thickness to the slab thickness is preferably 25% or more. Such magnetic stirring of the molten steel has an effect of suppressing formation of sulfides containing Cu. Even when the magnetic stirring is performed only in a region where the ratio of the one-side solidified shell thickness to the slab thickness is greater than 33%, the effect may not be obtained sufficiently. Thus, the ratio of the one-side solidified shell thickness to the slab thickness is preferably 33% or less. As long as the magnetic stirring is performed in a region where the ratio of the one-side solidified shell thickness to the slab thickness is 25% to 33%, the magnetic stirring may also be performed in the region where the ratio of the one-side solidified shell thickness to the slab thickness is greater than 33% together. Magnetically stirring the molten steel makes $Cu_2S$ more difficult to precipitate in the hot-rolled steel sheet and it is possible to easily obtain 3.5 or more of the grain diameter ratio of crystal grains observed on the surface of the grain-oriented electrical steel sheet being a final product. This is because hot rolling makes sulfides more finely precipitate to be dispersed.

When the slab heating temperature is less than 1300° C., a variation in magnetic flux density of the product is large. Thus, the slab heating temperature is 1300° C. or more. When the slab heating temperature is greater than 1490° C., the slab melts. Thus, the slab heating temperature is 1490° C. or less.

In the hot rolling, rough rolling with a finishing temperature set to 1200° C. or less is performed, and finish rolling with a start temperature set to 1000° C. or more and a finishing temperature set to 950° C. to 1100° C. is performed. When the finishing temperature of the rough rolling is greater than 1200° C., precipitation of MnS or MnSe in the rough rolling is not promoted, resulting in that $Cu_2S$ is generated in the finish rolling and the magnetic property of the product deteriorates. Thus, the finishing temperature of the rough rolling is 1200° C. or less. When the start temperature of the finish rolling is less than 1000° C., the finishing temperature of the finish rolling falls below 950° C., resulting in that $Cu_2S$ becomes likely to precipitate and the magnetic property of the product does not stabilize. Thus, the start temperature of the finish rolling is 1000° C. or more. When the finishing temperature of the finish rolling is less than 950° C., $Cu_2S$ becomes likely to precipitate and the magnetic property does not stabilize. Further, when the difference in temperature from the slab heating temperature is too large, it is difficult to make temperature histories over the entire length of a hot-rolled coil uniform, and thus it becomes difficult to form homogeneous inhibitors over the entire length of the hot-rolled coil. Thus, the finishing temperature of the finish rolling is 950° C. or more. When the finishing temperature of the finish rolling is greater than 1100° C., it is impossible to control fine dispersion of MnS and MnSe. Thus, the finishing temperature of the finish rolling is 1100° C. or less.

The finish rolling is started within 300 seconds after start of the rough rolling. When the time period between start of the rough rolling and start of the finish rolling is greater than 300 seconds, MnS or MnSe having 50 nm or less, which functions as an inhibitor, is no longer dispersed, grain diameter control in decarburization annealing and secondary recrystallization in finish annealing become difficult, and the magnetic property deteriorates. Thus, the time period between start of the rough rolling and start of the finish rolling is within 300 seconds. Incidentally, the lower limit of the time period does not need to be set in particular as long as the rolling is normal rolling. When the time period between start of the rough rolling and start of the finish rolling is less than 30 seconds, a precipitation amount of MnS or MnSe may not be sufficient and secondary recrystallized crystal grains may become difficult to grow at the time of finish annealing in some cases.

At the rear end of the hot-rolled steel sheet, precipitated MnS is likely to be coarse because a staying time period between start of the rough rolling and start of the finish rolling is longer than that at the center portion of the hot-rolled steel sheet. At the leading end of the hot-rolled steel sheet, MnS is likely to be coarse because the start temperature of the rough rolling is high. Containing Cu enables suppression of coarsening of MnS, and thereby as a result it becomes effective to reduce the variation in magnetic property in the coil.

Cooling at a cooling rate of 50° C./second or more is started within 10 seconds after finish of the finish rolling. When the time period between finish of the finish rolling and start of the cooling is greater than 10 seconds, $Cu_2S$ becomes likely to precipitate and the magnetic property of the product does not stabilize. Thus, the time period between finish of the finish rolling and start of the cooling is within 10 seconds, and preferably within two seconds. When the cooling rate after the finish rolling is less than 50° C./second, $Cu_2S$ becomes likely to precipitate and the magnetic property does not stabilize. Thus, the cooling rate after the finish rolling is 50° C./second or more.

Thereafter, coiling is performed in a temperature zone of 600° C. or less. When the coiling temperature is greater than 600° C., $Cu_2S$ becomes likely to precipitate and the magnetic property of the product does not stabilize. Thus, the coiling temperature is 600° C. or less.

In this manner, it is possible to manufacture the hot-rolled steel sheet for a grain-oriented electrical steel sheet according to this embodiment.

Next, there will be explained a manufacturing method of the grain-oriented electrical steel sheet according to an embodiment of the present invention. In the manufacturing method of the grain-oriented electrical steel sheet according to this embodiment, continuous casting of molten steel, hot rolling, hot-rolled sheet annealing, cold rolling, decarburization annealing, application of annealing separating agent, finish annealing, and the like are performed. The continuous casting of the molten steel and the hot rolling can be performed similarly to the above-described manufacturing method of the hot-rolled steel sheet for a grain-oriented electrical steel sheet.

Hot-rolled sheet annealing of the obtained hot-rolled steel sheet is performed. When the finishing temperature of the finish rolling is set to Tf, a holding temperature of the hot-rolled sheet annealing is 950° C. to (Tf+100)° C. When the holding temperature is less than 950° C., it is impossible to make the inhibitors homogeneous over the entire length of the hot-rolled coil and the magnetic property of the product does not stabilize. Thus, the holding temperature is 950° C. or more. When the holding temperature is greater than (Tf+100)° C., MnS that has finely precipitated in the hot rolling grows rapidly and the secondary recrystallization is destabilized. Thus, the holding temperature is (Tf+100)° C. or less. Performing the hot-rolled sheet annealing appropriately makes it possible to suppress coarsening and growth of MnS during finish annealing. A mechanism in which coarsening and growth are suppressed is inferred as follows. It is conceivable that Cu segregates to an interface between MnS and the parent phase to work suppressively on the growth of MnS. When the holding temperature of the hot-rolled sheet annealing is too high, with the growth of MnS, the interface to which Cu is likely to segregate disappears to no longer obtain an effect sufficiently. Further, it is inferred that no substantial precipitation of $Cu_2S$ in the hot-rolled steel sheet functions advantageously for obtaining such an effect of Cu. Elements such as P, Sn, Sb, and Bi, which are likely to segregate, can exhibit the similar function.

Next, one cold rolling, or two or more cold rollings with intermediate annealing therebetween are performed to obtain a cold-rolled steel sheet. Thereafter, decarburization annealing of the cold-rolled steel sheet is performed, application of an annealing separating agent containing MgO is performed, and finish annealing is performed. The annealing separating agent contains MgO, and the ratio of MgO in the annealing separating agent is 90 mass % or more, for example. In the finish annealing, purification annealing may be performed after the secondary recrystallization is completed. The cold rolling, the decarburization annealing, the application of the annealing separating agent, and the finish annealing can be performed by general methods.

In this manner, it is possible to manufacture the grain-oriented electrical steel sheet according to this embodiment. After the finish annealing, an insulation coating may be formed by application and baking.

The above-described manufacturing conditions in the manufacturing methods of the hot-rolled sheet for a grain-oriented electrical steel sheet and the grain-oriented electrical steel sheet according to the embodiments of the present invention are that $Cu_2S$ does not easily precipitate. The grain diameter ratio of crystal grains observed on the surface of the grain-oriented electrical steel sheet manufactured by using such a hot-rolled steel sheet becomes 3.0 or more. This mechanism is as follows. Although it is understood that MnS to be an inhibitor is uniformly dispersed by the hot rolling, when the precipitation of $Cu_2S$ is suppressed, MnS tends to streakily precipitate to be dispersed in the hot-rolled steel sheet stretched in the rolling direction, and thus the grain diameter ratio increases due to the grain growth of secondary recrystallization in the finish annealing.

From the above, according to the manufacturing methods of the hot-rolled steel sheet for a grain-oriented electrical steel sheet and the grain-oriented electrical steel sheet according to the embodiments of the present invention, it is possible to uniformize solution of precipitates functioning as an inhibitor and fine precipitation in hot rolling over an entire length of a slab and obtain a low-core loss grain-oriented electrical steel sheet that enables a good and less varied magnetic property over an entire length of a coil and a hot-rolled steel sheet for the grain-oriented electrical steel sheet.

In the foregoing, the preferred embodiments of the present invention have been described in detail, but, the present invention is not limited to such examples. It is apparent that a person having common knowledge in the technical field to which the present invention belongs is able to devise various variation or modification examples within the range of technical ideas described in the claims, and it should be understood that such examples belong to the technical scope of the present invention as a matter of course.

EXAMPLE

Next, the hot-rolled steel sheet for a grain-oriented electrical steel sheet and the grain-oriented electrical steel sheet according to the embodiments of the present invention will be concretely explained while referring to examples. The following examples are merely examples of the hot-rolled steel sheet for a grain-oriented electrical steel sheet and the grain-oriented electrical steel sheet according to the embodiments of the present invention, and the hot-rolled steel sheet for a grain-oriented electrical steel sheet and the grain-oriented electrical steel sheet according to the present invention are not limited to the following examples.

Example 1

Steel types B and C illustrated in Table 1 were cast to fabricate slabs and six-pass hot rolling was performed on these slabs to obtain hot-rolled steel sheets each having a 2.3 mm sheet thickness. The preceding three passes were set to rough rolling with an inter-pass time period of 5 seconds to 10 seconds, and the subsequent three passes were set to finish rolling with an inter-pass time period of 2 seconds or less. Each underline in Table 1 indicates that a corresponding numerical value is outside the range of the present invention. In the casing of the molten steel, magnetic stirring was performed under the condition illustrated in Table 2. A slab heating temperature and a hot rolling condition are also illustrated in Table 2. As soon as hot rolling was finished, cooling down to 550° C. was performed by water spraying, holding was performed in an air atmosphere furnace for one hour at a temperature illustrated in Table 2, and thereby a heat treatment equivalent to coiling was performed. A cooling condition is also illustrated in Table 2. An existing state of sulfides of the obtained hot-rolled steel sheets was confirmed by the TEM. These results are illustrated in Table 2. Then, after being annealed at a temperature illustrated in Table 2, the hot-rolled steel sheets were reduced to a sheet thickness of 0.225 mm by cold rolling, subjected to decarburization annealing at 840° C., had an annealing separating agent containing MgO as its main component applied thereto, and subjected to finish annealing at 1170° C., and various grain-oriented electrical steel sheets were manufactured. Each grain diameter ratio of crystal grains observed on the surface of the obtained grain-oriented electrical steel sheets was obtained. These results are illustrated in Table 2. Each underline in Table 2 indicates that a corresponding numerical value is outside the range of the present invention.

TABLE 1

| STEEL | CHEMICAL COMPOSITION (mass %) | | | | | | | | | | |
|---|---|---|---|---|---|---|---|---|---|---|---|
| TYPE | C | Si | Mn | S | Se | Cu | Sn | Sb | ACID-SOLUBLE Al | N | OTHERS |
| A | 0.08 | 3.3 | 0.08 | 0.025 | <0.001 | 0.01 | 0.07 | <0.001 | 0.027 | 0.008 | <0.0002 |
| B | 0.08 | 3.3 | 0.08 | 0.025 | <0.001 | 0.11 | 0.10 | <0.001 | 0.027 | 0.008 | <0.0002 |
| C | 0.08 | 3.3 | 0.08 | 0.025 | <0.001 | 0.11 | 0.10 | <0.001 | 0.027 | 0.008 | Te = 0.0016 |
| D | 0.08 | 3.3 | 0.08 | 0.025 | <0.001 | 0.40 | 0.07 | <0.001 | 0.027 | 0.008 | <0.0002 |
| E | 0.08 | 3.3 | 0.08 | 0.025 | <0.001 | 0.41 | 0.07 | <0.001 | 0.027 | 0.008 | Bi = 0.0008 |
| F | 0.08 | 3.3 | 0.08 | 0.025 | <0.001 | 0.20 | <0.001 | <0.001 | 0.027 | 0.008 | <0.0002 |
| G | 0.08 | 3.3 | 0.08 | 0.010 | 0.015 | 0.40 | 0.05 | <0.001 | 0.027 | 0.008 | <0.0002 |
| H | 0.08 | 3.3 | 0.08 | 0.006 | 0.020 | 0.40 | 0.002 | 0.060 | 0.027 | 0.008 | <0.0002 |
| I | 0.08 | 3.3 | 0.03 | 0.027 | <0.001 | 0.60 | 0.002 | <0.001 | 0.027 | 0.008 | <0.0002 |
| J | 0.08 | 3.3 | 0.08 | 0.025 | <0.001 | 0.20 | 0.10 | <0.001 | 0.025 | 0.008 | La + Ce + Nd = 0.005 |
| K | 0.08 | 3.3 | 0.08 | 0.025 | <0.001 | 0.20 | 0.10 | <0.001 | 0.026 | 0.008 | Hf = 0.008 |
| L | 0.08 | 3.3 | 0.08 | 0.025 | <0.001 | 0.20 | 0.10 | <0.001 | 0.026 | 0.008 | Y = 0.007 |
| M | 0.08 | 3.3 | 0.08 | 0.025 | <0.001 | 0.22 | 0.10 | <0.001 | 0.026 | 0.008 | Ta = 0.004 |
| N | 0.08 | 3.3 | 0.08 | 0.025 | <0.001 | 0.12 | <0.001 | 0.050 | 0.027 | 0.008 | Pb = 0.005 |
| O | 0.07 | 3.3 | 0.08 | 0.052 | <0.001 | 0.90 | 0.05 | <0.001 | 0.027 | 0.008 | <0.0002 |
| P | 0.07 | 3.3 | 0.08 | 0.027 | <0.001 | 1.05 | 0.05 | <0.001 | 0.027 | 0.008 | Te = 0.0024 |
| Q | 0.07 | 3.3 | 0.08 | 0.025 | <0.001 | 0.55 | 0.05 | <0.001 | 0.027 | 0.008 | Bi = 0.0013 |

TABLE 2

| SAMPLE No. | STEEL TYPE | MAGNETIC STIRRING RATIO OF SOLIDIFIED SHELL THICKNESS (%) | SLAB HEATING TEMPERATURE (° C.) | HOT ROLLING: FINISHING TEMPERATURE OF ROUGH ROLLING (° C.) | HOT ROLLING: WAITING TIME (SECOND) | HOT ROLLING: START TEMPERATURE OF FINISHING ROLLING (° C.) | HOT ROLLING: FINISHING TEMPERATURE OF FINISHING ROLLING (° C.) | COOLING: WAITING TIME (SECOND) | COOLING: COOLING RATE (° C./s) | COILING TEMPERATURE (° C.) | HOT-ROLLED STEEL SHEET ANNEALING TEMPERATURE (° C.) | HOT-ROLLED STEEL SHEET: MnS, MnSe | HOT-ROLLED STEEL SHEET: $Cu_2S$ | GRAIN-ORIENTED ELECTRICAL STEEL SHEET GRAIN DIAMETER RATIO |
|---|---|---|---|---|---|---|---|---|---|---|---|---|---|---|
| 1 | B | 26 | 1350 | 1150 | 60 | 1100 | 1075 | 1.2 | 85 | 550 | 1120 | PRECIPITATED | NOT | 3.7 |
| 2 | B | 25 | 1360 | 1170 | 75 | 1120 | 1080 | 0.9 | 90 | 550 | 1140 | PRECIPITATED | NOT | 4.0 |
| 3 | B | NOT MAGNETIC STIRRING | 1350 | 1150 | 60 | 1100 | 1075 | 1.2 | 85 | 550 | 1120 | PRECIPITATED | NOT | 3.0 |
| 4 | B | 10 | 1360 | 1170 | 75 | 1120 | 1080 | 0.9 | 90 | 550 | 1140 | PRECIPITATED | NOT | 3.1 |
| 5 | B | 26 | 1350 | 1150 | 90 | 1100 | 1060 | 1.2 | 85 | 570 | 1120 | PRECIPITATED | NOT | 3.0 |
| 6 | B | 25 | 1360 | 1170 | 75 | 1120 | 1080 | 0.9 | 90 | 570 | 1140 | PRECIPITATED | NOT | 3.2 |
| 7 | B | 26 | 1350 | 1150 | 60 | 1100 | 1075 | 1.2 | 85 | 570 | 1120 | PRECIPITATED | NOT | 3.0 |
| 8 | B | 25 | 1350 | 1170 | 60 | 1120 | 1070 | 0.9 | 90 | 550 | 1140 | PRECIPITATED | NOT | 3.0 |
| 9 | B | 26 | 1280 | 1100 | 60 | 1080 | 1060 | 0.9 | 90 | 570 | 1140 | PRECIPITATED | NOT | 1.2 |
| 10 | B | 25 | 1500 | | | | NOT HOT ROLLING | | | | | — | — | — |
| 11 | B | 26 | 1350 | 1205 | 200 | 1080 | 1075 | 0.9 | 90 | 550 | 1140 | PRECIPITATED | PRECIPITATED | 1.3 |
| 12 | B | 25 | 1360 | 1150 | 320 | 1005 | 1020 | 1.1 | 70 | 550 | 1100 | PRECIPITATED | NOT | 1.1 |
| 13 | B | 26 | 1350 | 1160 | 80 | 980 | 930 | 0.8 | 70 | 550 | 1090 | PRECIPITATED | PRECIPITATED | 1.1 |
| 14 | B | 25 | 1360 | 1150 | 60 | 1100 | 940 | 1.5 | 60 | 500 | 1020 | PRECIPITATED | PRECIPITATED | 1.3 |
| 15 | B | 26 | 1350 | 1190 | 40 | 1160 | 1120 | 1.2 | 90 | 550 | 1140 | PRECIPITATED | NOT | 1.5 |
| 16 | B | 25 | 1360 | 1150 | 60 | 1100 | 1080 | 12.0 | 50 | 550 | 1120 | PRECIPITATED | PRECIPITATED | 1.1 |
| 17 | B | 26 | 1350 | 1170 | 75 | 1120 | 1075 | 3.0 | 45 | 550 | 1140 | PRECIPITATED | PRECIPITATED | 1.1 |
| 18 | B | 25 | 1360 | 1150 | 60 | 1100 | 1080 | 0.9 | 60 | 620 | 1140 | PRECIPITATED | PRECIPITATED | 1.2 |
| 19 | B | 26 | 1350 | 1170 | 75 | 1120 | 1075 | 0.9 | 80 | 550 | 930 | PRECIPITATED | NOT | 1.1 |
| 20 | B | 25 | 1360 | 1150 | 60 | 1100 | 1025 | 0.9 | 80 | 550 | 1140 | PRECIPITATED | NOT | 1.5 |
| 21 | C | 26 | 1350 | 1170 | 75 | 1120 | 1075 | 0.9 | 85 | 550 | 1120 | PRECIPITATED | NOT | 3.8 |
| 22 | C | 25 | 1360 | 1150 | 60 | 1100 | 1080 | 0.9 | 80 | 550 | 1140 | PRECIPITATED | NOT | 4.2 |
| 23 | C | NOT MAGNETIC STIRRING | 1350 | 1170 | 75 | 1120 | 1075 | 0.9 | 85 | 550 | 1120 | PRECIPITATED | NOT | 3.1 |

TABLE 2-continued

| SAMPLE No. | STEEL TYPE | MAGNETIC STIRRING RATIO OF SOLIDIFIED SHELL THICKNESS (%) | SLAB HEATING TEMPERATURE (° C.) | HOT ROLLING: FINISHING TEMPERATURE OF ROUGH ROLLING (° C.) | HOT ROLLING: WAITING TIME (SECOND) | HOT ROLLING: START TEMPERATURE OF FINISHING ROLLING (° C.) | HOT ROLLING: FINISHING TEMPERATURE OF FINISHING ROLLING (° C.) | COOLING: WAITING TIME (SECOND) | COOLING: COOLING RATE (° C./s) | COILING TEMPERATURE (° C.) | HOT-ROLLED STEEL SHEET ANNEALING TEMPERATURE (° C.) | HOT-ROLLED STEEL SHEET: MnS, MnSe | HOT-ROLLED STEEL SHEET: $Cu_2S$ | GRAIN-ORIENTED ELECTRICAL STEEL SHEET GRAIN DIAMETER RATIO |
|---|---|---|---|---|---|---|---|---|---|---|---|---|---|---|
| 24 | C | 20 | 1360 | 1150 | 60 | 1100 | 1080 | 0.9 | 85 | 550 | 1140 | PRECIPITATED | NOT | 3.2 |
| 25 | C | 26 | 1350 | 1170 | 75 | 1120 | 1060 | 0.9 | 85 | 550 | 1120 | PRECIPITATED | NOT | 3.0 |
| 26 | C | 25 | 1360 | 1150 | 60 | 1100 | 1065 | 0.9 | 85 | 570 | 1140 | PRECIPITATED | NOT | 3.0 |
| 27 | C | 26 | 1350 | 1170 | 75 | 1120 | 1075 | 1.2 | 70 | 570 | 1120 | PRECIPITATED | NOT | 3.1 |
| 28 | C | 25 | 1360 | 1150 | 60 | 1100 | 1050 | 2.1 | 75 | 570 | 1140 | PRECIPITATED | NOT | 3.1 |
| 29 | C | 26 | 1280 | 1170 | 75 | 1120 | 1070 | 2.2 | 80 | 550 | 1120 | PRECIPITATED | NOT | 1.1 |
| 30 | C | 25 | 1500 | | | | NOT HOT ROLLING | | | | | — | — | — |
| 31 | C | 26 | 1350 | 1210 | 220 | 1050 | 1060 | 2.1 | 80 | 550 | 1120 | PRECIPITATED | PRECIPITATED | 1.3 |
| 32 | C | 25 | 1360 | 1150 | 320 | 1100 | 1080 | 2.3 | 70 | 560 | 1140 | PRECIPITATED | NOT | 1.5 |
| 33 | C | 26 | 1350 | 1170 | 60 | 980 | 930 | 2.3 | 70 | 560 | 1120 | PRECIPITATED | PRECIPITATED | 1.2 |
| 34 | C | 25 | 1360 | 1150 | 75 | 1100 | 930 | 1.5 | 60 | 560 | 1140 | PRECIPITATED | PRECIPITATED | 1.1 |
| 35 | C | 26 | 1350 | 1170 | 60 | 1120 | 1120 | 1.5 | 80 | 550 | 1140 | PRECIPITATED | NOT | 1.1 |
| 36 | C | 25 | 1360 | 1150 | 75 | 1100 | 1075 | 12.0 | 50 | 550 | 1120 | PRECIPITATED | PRECIPITATED | 1.1 |
| 37 | C | 26 | 1350 | 1170 | 60 | 1120 | 1080 | 1.2 | 45 | 550 | 1120 | PRECIPITATED | PRECIPITATED | 1.0 |
| 38 | C | 25 | 1360 | 1150 | 75 | 1100 | 1075 | 1.2 | 55 | 620 | 1140 | PRECIPITATED | PRECIPITATED | 1.1 |
| 39 | C | 26 | 1350 | 1170 | 60 | 1120 | 1080 | 1.2 | 70 | 550 | 930 | PRECIPITATED | NOT | 1.2 |
| 40 | C | 24 | 1350 | 1150 | 80 | 1100 | 1065 | 1.2 | 70 | 550 | 1180 | PRECIPITATED | NOT | 1.5 |

As illustrated in Table 2, in Samples No. 1 to No. 8 and Samples No. 21 to No. 28, because of the slab heating temperature, the hot rolling condition, the cooling condition, the coiling temperature, and the holding temperature of the hot-rolled sheet annealing each being within the range of the present invention, a good result, which was the grain diameter ratio being 3.0 times or more, was obtained. Among these samples, in Samples No. 1, No. 2, No. 21, and No. 22, the magnetic stirring was performed at the time of casting the molten steel, so that an excellent result, which was the grain diameter ratio being 3.5 or more, was obtained.

In samples No. 9 and No. 29, because of the slab heating temperature being too low, the grain diameter ratio was small. In Samples No. 10 and No. 30, because of the slab heating temperature being too high, the subsequent hot rolling was not able to be performed. In Samples No. 11 and No. 31, because of the finishing temperature of the rough rolling being too high, the grain diameter ratio was small. In Samples No. 12 and No. 32, because of the time period between start of the rough rolling and start of the finish rolling being too long, the grain diameter ratio was small. In Samples No. 13 and No. 33, because of the start temperature of the finish rolling and the finishing temperature of the finish rolling being too low, the grain diameter ratio was small. In Samples No. 14 and No. 34, because of the finishing temperature of the finish rolling being too low, the grain diameter ratio was small. In Samples No. 15 and No. 35, because of the finishing temperature of the finish rolling being too high, the grain diameter ratio was small. In Samples No. 16 and No. 36, because of the time period between finish of the finish rolling and start of the cooling being too long, the grain diameter ratio was small. In Samples No. 17 and No. 37, because of the cooling rate after the finish rolling being too slow, the grain diameter ratio was small. In Samples No. 18 and No. 38, because of the coiling temperature being too high, the grain diameter ratio was small. In Samples No. 19 and No. 39, because of the holding temperature of the hot-rolled sheet annealing being too low, the grain diameter ratio was small. In Samples No. 20 and No. 40, because of the holding temperature of the hot-rolled sheet annealing being too high, the grain diameter ratio was small.

Example 2-1

Figure 2:
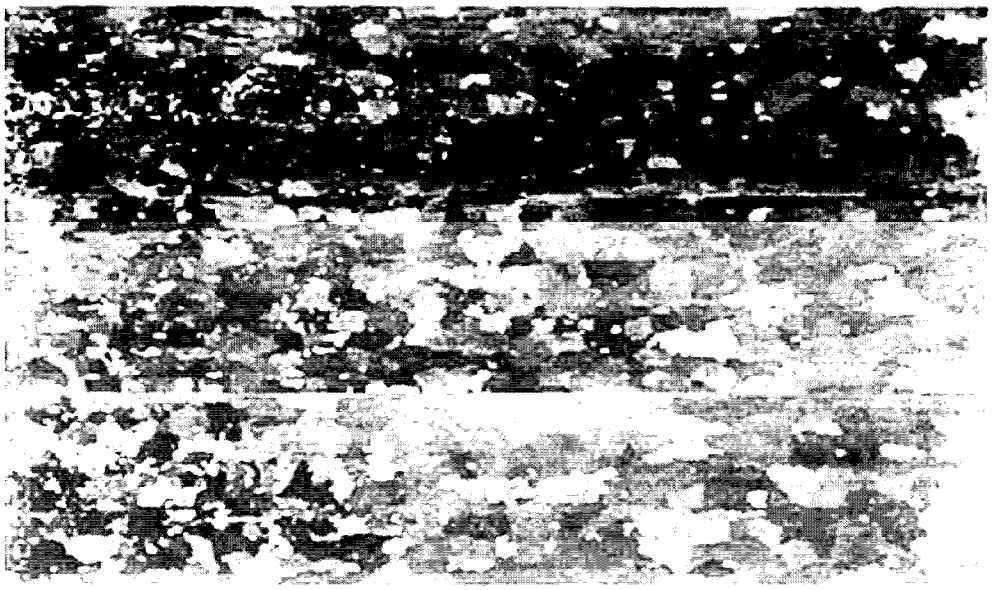
FIG. 2 is an image showing a crystal structure in the case of the Cu content being 0.01%.

Steel types A to N illustrated in Table 1 were cast to fabricate slabs, and six-pass hot rolling was performed on these slabs at 1350° C. for 30 minutes to obtain hot-rolled steel sheets each having a 2.3 mm sheet thickness. The preceding three passes were set to rough rolling with an inter-pass time period of 5 seconds to 10 seconds, and the subsequent three passes were set to finish rolling with an inter-pass time period of 2 seconds or less. The time period between start of the rough rolling and start of the finish rolling was set to 40 seconds to 180 seconds. The finishing temperature of the rough rolling was set to 1120° C. to 1160° C., and the start temperature of the finish rolling was set to 1000° C. to 1140° C. The finishing temperature Tf of the hot rolling (finish rolling) was set to 900° C. to 1060° C. As soon as the hot rolling was finished (finish rolling was finished), cooling down to 550° C. was performed by water spraying, holding was performed in an air atmosphere furnace for one hour at 550° C., and thereby a heat treatment equivalent to coiling was performed. The time period between finish of the finish rolling and start of the cooling was set to 0.7 seconds to 1.7 seconds, and the cooling rate after the finish rolling was set to 70° C./second or more. After being annealed at 900° C. to 1150° C., the obtained hot-rolled steel sheets were reduced to a sheet thickness of 0.225 mm by cold rolling, subjected to decarburization annealing at 840° C., had an annealing separating agent containing MgO as its main component applied thereto, and subjected to finish annealing at 1170° C. After water washing, the steel sheets were cut into to 60 mm in width×300 mm in length to be subjected to strain relief annealing at 850° C., and then subjected to a magnetic measurement. Results of the magnetic measurement are illustrated in Table 3. Each underline in Table 3 indicates that a corresponding numerical value is outside the range of the present invention. A crystal structure in the case of Cu: 0.4% is shown in FIG. 1, and a crystal structure in the case of Cu: 0.01% is shown in FIG. 2.

TABLE 3

| | | MAGNETIC STIRRING | HOT ROLLING | | HOT-ROLLED STEEL SHEET ANNEALING | |
|---|---|---|---|---|---|---|
| SAMPLE No. | STEEL TYPE | RATIO OF SOLIDIFIED SHELL THICKNESS (%) | FINISHING TEMPERATURE OF FINISHING ROLLING Tf (° C.) | WAITING TIME (SECOND) | TEMPERATURE T1 (° C.) | 950 < T1 < Tf + 100 |
| A1 | A | NOT | 1000 | 100 | 1080 | SATISFIED |
| A2 | A | NOT | 1000 | 100 | 1120 | NOT SATISFIED |
| A3 | A | NOT | 1000 | 100 | 1150 | NOT SATISFIED |
| B1 | B | NOT | 1000 | 110 | 1080 | SATISFIED |
| B2 | B | NOT | 1000 | 110 | 1120 | NOT SATISFIED |
| B3 | B | NOT | 1000 | 110 | 1150 | NOT SATISFIED |
| C1 | C | NOT | 1000 | 100 | 1080 | SATISFIED |
| C2 | C | NOT | 1060 | 40 | 1120 | SATISFIED |
| C3 | C | NOT | 1000 | 100 | 1150 | NOT SATISFIED |
| D1 | D | NOT | 1000 | 100 | 1080 | SATISFIED |
| D2 | D | NOT | 1000 | 100 | 1120 | NOT SATISFIED |
| D3 | D | NOT | 1000 | 100 | 1150 | NOT SATISFIED |
| D4 | D | NOT | 1060 | 40 | 1080 | SATISFIED |
| D5 | D | NOT | 1060 | 40 | 1120 | SATISFIED |
| D6 | D | NOT | 1060 | 40 | 900 | NOT SATISFIED |
| E1 | E | NOT | 1000 | 105 | 1080 | SATISFIED |
| E2 | E | NOT | 1000 | 105 | 1120 | NOT SATISFIED |
| E3 | E | NOT | 1000 | 105 | 1150 | NOT SATISFIED |

TABLE 3-continued

| | | | | | | |
|---|---|---|---|---|---|---|
| F1 | F | NOT | 1000 | 100 | 1080 | SATISFIED |
| G1 | G | NOT | 1000 | 100 | 1080 | SATISFIED |
| H1 | H | NOT | 1000 | 100 | 1080 | SATISFIED |
| I1 | I | NOT | 900 | 180 | 900 | NOT SATISFIED |
| J1 | J | NOT | 1010 | 110 | 1080 | SATISFIED |
| K1 | K | NOT | 1010 | 110 | 1080 | SATISFIED |
| L1 | L | NOT | 1010 | 110 | 1080 | SATISFIED |
| M1 | M | NOT | 1010 | 110 | 1080 | SATISFIED |
| N1 | N | NOT | 1010 | 110 | 1080 | SATISFIED |
| O1 | O | NOT | 1040 | 45 | 1080 | SATISFIED |
| O2 | O | NOT | 1000 | 110 | 1080 | SATISFIED |
| P1 | P | NOT | 1050 | 30 | 1100 | SATISFIED |
| P2 | P | NOT | 1000 | 110 | 1080 | SATISFIED |
| Q1 | Q | NOT | 930 | 100 | 1020 | SATISFIED |

| | HOT-ROLLED | GRAIN-ORIENTED ELECTRICAL STEEL SHEET | | |
|---|---|---|---|---|
| SAMPLE No. | STEEL SHEET PRECIPITATE | GRAIN DIAMETER RATIO | B8 (T) | NOTE |
| A1 | MnS | 1.5 | 1.876 | COMPARATIVE EXAMPLE |
| A2 | MnS | 1.4 | 1.852 | COMPARATIVE EXAMPLE |
| A3 | MnS | 1.2 | 1.622 | COMPARATIVE EXAMPLE |
| B1 | MnS | 3.0 | 1.916 | INVENTION EXAMPLE |
| B2 | MnS | 1.3 | 1.872 | COMPARATIVE EXAMPLE |
| B3 | MnS | 1.1 | 1.672 | COMPARATIVE EXAMPLE |
| C1 | MnS | 3.7 | 1.932 | INVENTION EXAMPLE |
| C2 | MnS | 3.5 | 1.935 | INVENTION EXAMPLE |
| C3 | MnS | 1.2 | 1.691 | COMPARATIVE EXAMPLE |
| D1 | MnS | 3.6 | 1.934 | INVENTION EXAMPLE |
| D2 | MnS | 1.3 | 1.718 | COMPARATIVE EXAMPLE |
| D3 | MnS | 1.1 | 1.643 | COMPARATIVE EXAMPLE |
| D4 | MnS | 3.8 | 1.932 | INVENTION EXAMPLE |
| D5 | MnS | 3.2 | 1.923 | INVENTION EXAMPLE |
| D6 | MnS | 1.7 | 1.655 | COMPARATIVE EXAMPLE |
| E1 | MnS | 4.3 | 1.970 | INVENTION EXAMPLE |
| E2 | MnS | 2.2 | 1.780 | COMPARATIVE EXAMPLE |
| E3 | MnS | 1.3 | 1.650 | COMPARATIVE EXAMPLE |
| F1 | MnS | 3.0 | 1.908 | INVENTION EXAMPLE |
| G1 | MnS, MnSe | 3.3 | 1.917 | INVENTION EXAMPLE |
| H1 | MnS, MnSe | 3.3 | 1.915 | INVENTION EXAMPLE |
| I1 | MnS, $Cu_2S$ | — | 1.620 | COMPARATIVE EXAMPLE |
| J1 | MnS | 3.5 | 1.822 | INVENTION EXAMPLE |
| K1 | MnS | 3.2 | 1.925 | INVENTION EXAMPLE |
| L1 | MnS | 3.3 | 1.931 | INVENTION EXAMPLE |
| M1 | MnS | 4.1 | 1.928 | INVENTION EXAMPLE |
| N1 | MnS | 3.8 | 1.916 | INVENTION EXAMPLE |
| O1 | MnS, $Cu_2S$ | 1.5 | 1.889 | COMPARATIVE EXAMPLE |
| O2 | MnS, $Cu_2S$ | 1.2 | 1.756 | COMPARATIVE EXAMPLE |
| P1 | MnS, $Cu_2S$ | 1.3 | 1.749 | COMPARATIVE EXAMPLE |
| P2 | MnS.$Cu_2S$ | 1.3 | 1.825 | COMPARATIVE EXAMPLE |
| Q1 | MnS, $Cu_2S$ | 1.2 | 1.878 | COMPARATIVE EXAMPLE |

Table 3 revealed improvements in absolute value of the properties obtained by containing Cu. Experiment conditions of this example are similar to those at the leading end of the hot-rolled steel sheet because the start temperature of the rough rolling is high and the staying time period between start of the rough rolling and start of the finish rolling is short, and the possibility of improvement in property deterioration was also exhibited at the leading end and the rear end of the hot-rolled steel sheet. It was confirmed that the high Cu content contributes to the improvement in magnetic property.

As illustrated in Table 3, in Samples No. B1, No. C1, No. C2, No. D1, No. D4, No. D5, No. E1, No. F1, No. G1, No. H1, No. J1, No. K1, No. L1, No. M1, and No. N1, because of the hot rolling condition, the holding temperature of the hot-rolled sheet annealing, and the chemical composition each being within the range of the present invention, the grain diameter ratio was 3.0 times or more and a good magnetic property was able to be obtained. Among these samples, in Samples No. D1, No. D4, No. D5, No. G1, and No. H1, because of the high Cu content, an excellent magnetic property was able to be obtained.

In Sample No. A1, because of the Cu content being too low, the grain diameter ratio was small. In Samples No. A2 and No. A3, because of the Cu content being low and the holding temperature of the hot-rolled sheet annealing being too high, the grain diameter ratio was small. In Samples No. B2, No. B3, No. C3, No. D2, No. D3, No. E2, and No. E3, because of the holding temperature of the hot-rolled sheet annealing being too high, the grain diameter ratio was small. In Sample No. D6, because of the holding temperature of the hot-rolled sheet annealing being too low, the grain diameter ratio was small. In Sample No. I1, because of the finishing temperature of the finish rolling being low and the holding temperature of the hot-rolled sheet annealing being too low, $Cu_2S$ precipitated. In Samples No. O1 and No. O2, because of the S content being high and the Cu content being relatively high though being within the range of the present invention, $Cu_2S$ precipitated. In Samples No. P1 and No. P2, because of the Cu content being too high, $Cu_2S$ precipitated. In Sample No. Q1, because of the finishing temperature of the finish rolling being low and the holding temperature of the hot-rolled sheet annealing being too low, $Cu_2S$ precipitated.

Example 2-2

The same operation as in Example 2-1 was performed except that the magnetic stirring was performed under the condition illustrated in Table 4 at the time of casting molten steel. Grain diameter ratios and magnetic measurement results are illustrated in Table 4. Each underline in Table 4 indicates that a corresponding numerical value is outside the range of the present invention.

TABLE 4

| | | MAGNETIC STIRRING | HOT ROLLING | | HOT-ROLLED STEEL SHEET ANNEALING | |
|---|---|---|---|---|---|---|
| SAMPLE No. | STEEL TYPE | RATIO OF SOLIDIFIED SHELL THICKNESS (%) | FINISHING TEMPERATURE OF FINISHING ROLLING Tf (° C.) | WAITING TIME (SECOND) | TEMPERATURE T1 (° C.) | 950 < T1 < Tf + 100 |
| A4 | A | 25 | 1000 | 100 | 1080 | SATISFIED |
| A5 | A | 25 | 1000 | 100 | 1120 | NOT SATISFIED |
| A6 | A | 25 | 1000 | 100 | 1150 | NOT SATISFIED |
| B4 | B | 25 | 1000 | 110 | 1080 | SATISFIED |
| B5 | B | 25 | 1000 | 110 | 1120 | NOT SATISFIED |
| B6 | B | 25 | 1000 | 110 | 1150 | NOT SATISFIED |
| C4 | C | 25 | 1000 | 100 | 1080 | SATISFIED |
| C5 | C | 25 | 1060 | 40 | 1120 | SATISFIED |
| C6 | C | 25 | 1000 | 100 | 1150 | NOT SATISFIED |
| D7 | D | 25 | 1000 | 100 | 1080 | SATISFIED |
| D8 | D | 25 | 1000 | 100 | 1120 | NOT SATISFIED |
| D9 | D | 25 | 1000 | 100 | 1150 | NOT SATISFIED |
| D10 | D | 25 | 1060 | 40 | 1080 | SATISFIED |
| D11 | D | 25 | 1060 | 40 | 1120 | SATISFIED |
| D12 | D | 25 | 1060 | 40 | 900 | NOT SATISFIED |
| E4 | E | 25 | 1000 | 105 | 1080 | SATISFIED |
| E5 | E | 25 | 1000 | 105 | 1120 | NOT SATISFIED |
| E6 | E | 25 | 1000 | 105 | 1150 | NOT SATISFIED |
| F2 | F | 25 | 1000 | 100 | 1080 | SATISFIED |
| G2 | G | 25 | 1000 | 100 | 1080 | SATISFIED |
| H2 | H | 25 | 1000 | 100 | 1080 | SATISFIED |
| I2 | I | 25 | 900 | 180 | 900 | NOT SATISFIED |
| J2 | J | 25 | 1010 | 110 | 1080 | SATISFIED |
| K2 | K | 25 | 1010 | 110 | 1080 | SATISFIED |
| L2 | L | 25 | 1010 | 110 | 1080 | SATISFIED |
| M2 | M | 25 | 1010 | 110 | 1080 | SATISFIED |
| N2 | N | 25 | 1010 | 110 | 1080 | SATISFIED |
| O3 | O | 25 | 1040 | 45 | 1080 | SATISFIED |
| O4 | O | 25 | 1000 | 110 | 1080 | SATISFIED |
| P3 | P | 25 | 1050 | 30 | 1100 | SATISFIED |
| P4 | P | 25 | 1000 | 110 | 1080 | SATISFIED |
| Q2 | Q | 25 | 930 | 100 | 1020 | SATISFIED |

| | HOT-ROLLED | GRAIN-ORIENTED ELECTRICAL STEEL SHEET | | |
|---|---|---|---|---|
| SAMPLE No. | STEEL SHEET PRECIPITATE | GRAIN DIAMETER RATIO | B8 (T) | NOTE |
| A4 | MnS | 2.0 | 1.886 | COMPARATIVE EXAMPLE |
| A5 | MnS | 1.9 | 1.866 | COMPARATIVE EXAMPLE |
| A6 | MnS | 1.7 | 1.852 | COMPARATIVE EXAMPLE |
| B4 | MnS | 3.5 | 1.925 | INVENTION EXAMPLE |
| B5 | MnS | 1.8 | 1.876 | COMPARATIVE EXAMPLE |
| B6 | MnS | 1.6 | 1.765 | COMPARATIVE EXAMPLE |
| C4 | MnS | 4.2 | 1.933 | INVENTION EXAMPLE |
| C5 | MnS | 4.0 | 1.931 | INVENTION EXAMPLE |
| C6 | MnS | 1.7 | 1.895 | COMPARATIVE EXAMPLE |
| D7 | MnS | 4.1 | 1.936 | INVENTION EXAMPLE |
| D8 | MnS | 1.8 | 1.852 | COMPARATIVE EXAMPLE |
| D9 | MnS | 1.6 | 1.859 | COMPARATIVE EXAMPLE |
| D10 | MnS | 4.3 | 1.938 | INVENTION EXAMPLE |
| D11 | MnS | 3.7 | 1.929 | INVENTION EXAMPLE |
| D12 | MnS | 2.2 | 1.901 | COMPARATIVE EXAMPLE |
| E4 | MnS | 4.8 | 1.942 | INVENTION EXAMPLE |

TABLE 4-continued

| | | | | |
|---|---|---|---|---|
| E5 | MnS | 2.7 | 1.904 | COMPARATIVE EXAMPLE |
| E6 | MnS | 1.8 | 1.873 | COMPARATIVE EXAMPLE |
| F2 | MnS | 3.5 | 1.942 | INVENTION EXAMPLE |
| G2 | MnS, MnSe | 3.8 | 1.931 | INVENTION EXAMPLE |
| H2 | MnS, MnSe | 3.8 | 1.951 | INVENTION EXAMPLE |
| I2 | MnS, $Cu_2S$ | — | 1.844 | COMPARATIVE EXAMPLE |
| J2 | MnS | 4.0 | 1.944 | INVENTION EXAMPLE |
| K2 | MnS | 3.7 | 1.934 | INVENTION EXAMPLE |
| L2 | MnS | 3.8 | 1.938 | INVENTION EXAMPLE |
| M2 | MnS | 4.6 | 1.958 | INVENTION EXAMPLE |
| N2 | MnS | 4.3 | 1.951 | INVENTION EXAMPLE |
| O3 | MnS, $Cu_2S$ | 1.3 | 1.899 | COMPARATIVE EXAMPLE |
| O4 | MnS, $Cu_2S$ | 1.2 | 1.855 | COMPARATIVE EXAMPLE |
| P3 | MnS, $Cu_2S$ | 1.2 | 1.742 | COMPARATIVE EXAMPLE |
| P4 | MnS, $Cu_2S$ | 1.1 | 1.791 | COMPARATIVE EXAMPLE |
| Q2 | MnS, $Cu_2S$ | 1.0 | 1.632 | COMPARATIVE EXAMPLE |

As illustrated in Table 4, in Samples No. B4, No. C4, No. C5, No. D7, No. D10, No. D11, No. E4, No. F2, No. G2, No. H2, No. J2, No. K2, No. L2, No. M2, and No. N2, because the hot rolling condition, the holding temperature of the hot-rolled sheet annealing, and the chemical composition were each within the range of the present invention and the magnetic stirring was performed at the time of casting molten steel, the grain diameter ratio was 3.5 or more and a good magnetic property was able to be obtained.

In Sample No. A4, because of the Cu content being too low, the grain diameter ratio was small. In Samples No. A5 and No. A6, because of the Cu content being low and the holding temperature of the hot-rolled sheet annealing being too high, the grain diameter ratio was small. In Samples No. B5, No. B6, No. C6, No. D8, No. D9, No. E5, and No. E6, because of the holding temperature of the hot-rolled sheet annealing being too high, the grain diameter ratio was small. In Sample No. D12, because of the holding temperature of the hot-rolled sheet annealing being too low, the grain diameter ratio was small. In Sample No. 12, because of the finishing temperature of the finish rolling being low and the holding temperature of the hot-rolled sheet annealing being too low, $Cu_2S$ precipitated. In Samples No. O3 and No. O4, because of the S content being high and the Cu content being relatively high though being within the range of the present invention, $Cu_2S$ precipitated. In Samples No. P3 and No. P4, because of the Cu content being too high, $Cu_2S$ precipitated. In Sample No. Q2, because of the finishing temperature of the finish rolling being low and the holding temperature of the hot-rolled sheet annealing being too low, $Cu_2S$ precipitated.

Example 3-1

Steel types A, B, C, and H illustrated in Table 1 were cast to fabricate slabs, and these slabs were heated for 30 minutes at 1350° C. to be subjected to six-pass hot rolling, and hot-rolled steel sheets each having a 2.3 mm sheet thickness were obtained. The preceding three passes were set to rough rolling with an inter-pass time period of 5 seconds to 10 seconds, and the subsequent three passes were set to finish rolling with an inter-pass time period of 2 seconds or less. After the preceding three-pass rolling, the heat was kept to 1100° C. or more for a predetermined time period, and the time period between start of the rough rolling and start of the finish rolling (waiting time) was adjusted as illustrated in Table 5. The finishing temperature Tf of the hot rolling (finish rolling) was set to two types of 1000° C. and 1060° C. As soon as the hot rolling was finished (finish rolling was finished), cooling down to 550° C. was performed by water spraying. Besides, the hot rolling condition was set as follows. That is, the finishing temperature of the rough rolling was set to 1120° C. to 1160° C., the start temperature of the finish rolling was set to 1000° C. to 1140° C., the time period between finish of the finish rolling and start of the cooling was set to 0.7 seconds to 1.7 seconds, the cooling rate after the finish rolling was set to 70° C./second, and the coiling temperature was set to 550° C., (which was simulated by a heat treatment by one-hour holding in an air atmosphere furnace). After being annealed at 1080° C. to 1100° C., the obtained hot-rolled steel sheets were reduced to a sheet thickness of 0.225 mm by cold rolling, subjected to decarburization annealing at 840° C., had an annealing separating agent containing MgO as its main component applied thereto, and subjected to finish annealing at 1170° C. After water washing, the steel sheets were cut into to 60 mm in width×300 mm in length to be subjected to strain relief annealing at 850° C., and then subjected to a magnetic measurement. Results of the magnetic measurement are illustrated in Table 5. Each underline in Table 5 indicates that a corresponding numerical value is outside the range of the present invention.

TABLE 5

| | | MAGNETIC STIRRING | HOT ROLLING | | | | GRAIN-ORIENTED ELECTRICAL STEEL SHEET | | |
|---|---|---|---|---|---|---|---|---|---|
| SAMPLE No. | STEEL TYPE | RATIO OF SOLIDIFIED SHELL THICKNESS (%) | FINISHING TEMPERATURE OF FINISHING ROLLING Tf (° C.) | WAITING TIME (SECOND) | ANNEALING TEMPERATURE T1 (° C.) | HOT-ROLLED STEEL SHEET PRECIPITATE | GRAIN DIAMETER RATIO | B8 (T) | NOTE |
| A7 | A | NOT | 1060 | 25 | 1100 | MnS | 1.1 | 1.811 | COMPARATIVE EXAMPLE |
| A8 | A | NOT | 1060 | 120 | 1100 | MnS | 1.3 | 1.894 | COMPARATIVE EXAMPLE |

TABLE 5-continued

| SAMPLE No. | STEEL TYPE | MAGNETIC STIRRING RATIO OF SOLIDIFIED SHELL THICKNESS (%) | HOT ROLLING FINISHING TEMPERATURE OF FINISHING ROLLING Tf (° C.) | HOT ROLLING WAITING TIME (SECOND) | ANNEALING TEMPERATURE T1 (° C.) | HOT-ROLLED STEEL SHEET PRECIPITATE | GRAIN-ORIENTED ELECTRICAL STEEL SHEET GRAIN DIAMETER RATIO | B8 (T) | NOTE |
|---|---|---|---|---|---|---|---|---|---|
| A9 | A | NOT | 1060 | 280 | 1100 | MnS | 1.2 | 1.722 | COMPARATIVE EXAMPLE |
| B7 | B | NOT | 1060 | 60 | 1100 | MnS | 3.2 | 1.933 | INVENTION EXAMPLE |
| B8 | B | NOT | 1060 | 180 | 1100 | MnS | 3.5 | 1.924 | INVENTION EXAMPLE |
| B9 | B | NOT | 1060 | 280 | 1100 | MnS | 3.0 | 1.922 | INVENTION EXAMPLE |
| C7 | C | NOT | 1060 | 35 | 1100 | MnS | 3.7 | 1.937 | INVENTION EXAMPLE |
| C8 | C | NOT | 1060 | 180 | 1100 | MnS | 3.5 | 1.945 | INVENTION EXAMPLE |
| C9 | C | NOT | 1060 | 270 | 1100 | MnS | 3.3 | 1.941 | INVENTION EXAMPLE |
| H3 | H | NOT | 1000 | 100 | 1080 | MnS, MnSe | 3.3 | 1.915 | INVENTION EXAMPLE |
| H4 | H | NOT | 1000 | 250 | 1080 | MnS, MnSe | 3.1 | 1.921 | INVENTION EXAMPLE |
| H5 | H | NOT | 1000 | 350 | 1080 | MnS, MnSe | 1.6 | 1.759 | COMPARATIVE EXAMPLE |

As illustrated in Table 5, in Samples No. B7 to No. B9, No. C7 to No. C9, No. H3, and No. H4, because of the hot rolling condition, the holding temperature of the hot-rolled sheet annealing, and the chemical composition each being within the range of the present invention, a good result being the grain diameter ratio of 3.0 times or more was able to be obtained. As long as the time period between start of the rough rolling and start of the finish rolling was within 300 seconds, a stable and good magnetic property was able to be obtained.

In Samples No. A7 to No. A9, because of the Cu content being too low, the grain diameter ratio was small. In Sample No. H5, because of the time period between start of the rough rolling and start of the finish rolling being too long, the magnetic property was inferior.

Example 3-2

The same operation as in Example 3-1 was performed except that the magnetic stirring was performed under the condition illustrated in Table 6 at the time of casting molten steel. Grain diameter ratios and magnetic measurement results are illustrated in Table 6. Each underline in Table 6 indicates that a corresponding numerical value is outside the range of the present invention.

TABLE 6

| SAMPLE No. | STEEL TYPE | MAGNETIC STIRRING RATIO OF SOLIDIFIED SHELL THICKNESS (%) | HOT ROLLING FINISHING TEMPERATURE OF FINISHING ROLLING Tf (° C.) | HOT ROLLING WAITING TIME (SECOND) | ANNEALING TEMPERATURE T1 (° C.) | HOT-ROLLED STEEL SHEET PRECIPITATE | GRAIN-ORIENTED ELECTRICAL STEEL SHEET GRAIN DIAMETER RATIO | B8 (T) | NOTE |
|---|---|---|---|---|---|---|---|---|---|
| A10 | A | 25 | 1060 | 25 | 1100 | MnS | 1.6 | 1.798 | COMPARATIVE EXAMPLE |
| A11 | A | 25 | 1060 | 120 | 1100 | MnS | 1.8 | 1.822 | COMPARATIVE EXAMPLE |
| A12 | A | 25 | 1060 | 280 | 1100 | MnS | 1.7 | 1883 | COMPARATIVE EXAMPLE |
| B10 | B | 25 | 1060 | 60 | 1100 | MnS | 3.7 | 1.936 | INVENTION EXAMPLE |
| B11 | B | 25 | 1060 | 180 | 1100 | MnS | 4.0 | 1.944 | INVENTION EXAMPLE |
| B12 | B | 25 | 1060 | 280 | 1100 | MnS | 3.5 | 1.931 | INVENTION EXAMPLE |
| C10 | C | 25 | 1060 | 35 | 1100 | MnS | 4.2 | 1.921 | INVENTION EXAMPLE |
| C11 | C | 25 | 1060 | 180 | 1100 | MnS | 4.0 | 1.932 | INVENTION EXAMPLE |
| C12 | C | 25 | 1060 | 270 | 1100 | MnS | 3.8 | 1.933 | INVENTION EXAMPLE |

TABLE 6-continued

| SAMPLE No. | STEEL TYPE | MAGNETIC STIRRING: RATIO OF SOLIDIFIED SHELL THICKNESS (%) | HOT ROLLING: FINISHING TEMPERATURE OF FINISHING ROLLING Tf (° C.) | HOT ROLLING: WAITING TIME (SECOND) | ANNEALING TEMPERATURE T1 (° C.) | HOT-ROLLED STEEL SHEET PRECIPITATE | GRAIN-ORIENTED ELECTRICAL STEEL SHEET: GRAIN DIAMETER RATIO | GRAIN-ORIENTED ELECTRICAL STEEL SHEET: B8 (T) | NOTE |
|---|---|---|---|---|---|---|---|---|---|
| H6 | H | 25 | 1000 | 100 | 1080 | MnS, MnSe | 3.8 | 1.941 | INVENTION EXAMPLE |
| H7 | H | 25 | 1000 | 250 | 1080 | MnS, MnSe | 3.6 | 1.935 | INVENTION EXAMPLE |
| H8 | H | 25 | 1000 | 350 | 1080 | MnS, MnSe | 2.1 | 1.861 | COMPARATIVE EXAMPLE |

As illustrated in Table 6, in Samples No. B10 to No. B12, No. C10 to No. C12, No. H6, and No. H7, because the hot rolling condition, the holding temperature of the hot-rolled sheet annealing, and the chemical composition were each within the range of the present invention and the magnetic stirring was performed at the time of casting molten steel, the grain diameter ratio was 3.5 or more and an excellent magnetic property was able to be obtained.

In Samples No. A10 to No. A12, because of the Cu content being too low, the grain diameter ratio was small. In Sample No. H8, because the time period between start of the rough rolling and start of the finish rolling being too long, the magnetic property was inferior.

Example 4-1

Steel type D illustrated in Table 1 was cast to fabricate a slab, and the slab was heated for 30 minutes at 1350° C. to be subjected to six-pass hot rolling, and a hot-rolled steel sheet having a 2.3 mm sheet thickness was obtained. The preceding three passes were set to rough rolling with an inter-pass time period of 5 seconds to 10 seconds, and the subsequent three passes were set to finish rolling with an inter-pass time period of 2 seconds or less. The hot rolling condition is illustrated in Table 7. After being annealed at 1100° C., the obtained hot-rolled steel sheet was reduced to a sheet thickness of 0.225 mm by cold rolling, subjected to decarburization annealing at 840° C., had an annealing separating agent containing MgO as its main component applied thereto, and subjected to finish annealing at 1170° C. After water washing, the steel sheet was cut into to 60 mm in width×300 mm in length to be subjected to strain relief annealing at 850° C., and then subjected to a magnetic measurement. Results of the magnetic measurement are illustrated in Table 7. Each underline in Table 7 indicates that a corresponding numerical value is outside the range of the present invention.

TABLE 7

| SAMPLE No. | STEEL TYPE | MAGNETIC STIRRING: RATIO OF SOLIDIFIED SHELL THICKNESS (%) | HOT ROLLING: FINISHING TEMPERATURE OF ROUGH ROLLING (° C.) | HOT ROLLING: WAITING TIME (SECOND) | HOT ROLLING: START TEMPERATURE OF FINISHING ROLLING (° C.) | HOT ROLLING: FINISHING TEMPERATURE OF FINISHING ROLLING (° C.) | COOLING: WAITING TIME (SECOND) | COOLING: COOLING RATE (° C./s) |
|---|---|---|---|---|---|---|---|---|
| D13 | D | NOT | 1220 | 27 | 1180 | 1090 | 0.7 | 100 |
| D14 | D | NOT | 1150 | 200 | 990 | 930 | 1.5 | 70 |
| D15 | D | NOT | 1150 | 150 | 1140 | 1000 | 12.0 | 70 |
| D16 | D | NOT | 1155 | 60 | 1170 | 1060 | 0.9 | 30 |
| D17 | D | NOT | 1140 | 180 | 1180 | 1060 | 0.8 | 100 |
| D18 | D | NOT | 1150 | 250 | 1160 | 1060 | 0.5 | 100 |

| SAMPLE No. | COILING TEMPERATURE (° C.) | HOT-ROLLED STEEL SHEET PRECIPITATE | GRAIN-ORIENTED ELECTRICAL STEEL SHEET: GRAIN DIAMETER RATIO | GRAIN-ORIENTED ELECTRICAL STEEL SHEET: B8 (T) | NOTE |
|---|---|---|---|---|---|
| D13 | 550 | MnS, $Cu_2S$ | 1.1 | 1.841 | COMPARATIVE EXAMPLE |
| D14 | 550 | MnS, $Cu_2S$ | 1.1 | 1.591 | COMPARATIVE EXAMPLE |
| D15 | 550 | MnS, $Cu_2S$ | 1.2 | 1.723 | COMPARATIVE EXAMPLE |
| D16 | 550 | MnS, $Cu_2S$ | 1.6 | 1.818 | COMPARATIVE EXAMPLE |
| D17 | 750 | MnS, $Cu_2S$ | 1.0 | 1.624 | COMPARATIVE EXAMPLE |
| D18 | 550 | MnS | 3.0 | 1.929 | INVENTION EXAMPLE |

As a result that the chemical compositions in Samples No. D13 to No. D18 in which secondary recrystallization was caused after the finish annealing were analyzed, it was confirmed that Si: 3.2%, Mn: 0.08%, Cu: 0.40%, and Sn: 0.07% were contained in each sample. Further, analysis results of other impurities were C: 12 ppm to 20 ppm, S: less than 5 ppm, Se: less than 0.0002%, Sb: less than 0.001%, acid-soluble Al: less than 0.001%, and N: 15 ppm to 25 ppm, and it was confirmed that purification was performed in each sample.

As illustrated in Table 7, in Sample No. D18, because of the hot rolling condition, the cooling condition, and the coiling temperature each being within the range of the present invention, a good result being the grain diameter ratio of 3.0 times or more was able to be obtained.

In Sample No. D13, because of the finishing temperature of the rough rolling being too high, the grain diameter ratio was small. In Sample No. D14, because of the start temperature of the finish rolling and the finishing temperature of the finish rolling being too low, the grain diameter ratio was small. In Sample No. D15, the time period between finish of the finish rolling and start of the cooling being too long, the grain diameter ratio was small. In Sample No. D16, because of the cooling rate after the finish rolling being too slow, the grain diameter ratio was small. In Sample No. D17, because of the coiling temperature being too high, the grain diameter ratio was small.

Example 4-2

The same operation as in Example 4-1 was performed except that the magnetic stirring was performed under the condition illustrated in Table 8 at the time of casting molten steel. Grain diameter ratios and magnetic measurement results are illustrated in Table 8. Each underline in Table 8 indicates that a corresponding numerical value is outside the range of the present invention.

As illustrated in Table 8, in Sample No. D24, because the hot rolling condition, the cooling condition, and the coiling temperature were each within the range of the present invention and the magnetic stirring was performed at the time of casting molten steel, the grain diameter ratio was 3.5 or more and an excellent magnetic property was able to be obtained.

In Sample No. D19, because of the finishing temperature of the rough rolling being too high, the grain diameter ratio was small. In Sample No. D20, because of the start temperature of the finish rolling and the finishing temperature of the finish rolling being too low, the grain diameter ratio was small. In Sample No. D21, because of the time period between finish of the finish rolling and start of the cooling being too long, the grain diameter ratio was small. In Sample No. D22, because of the cooling rate after the finish rolling being too slow, the grain diameter ratio was small. In Sample No. D23, because of the coiling temperature being too high, the grain diameter ratio was small.

The invention claimed is:

1. A grain-oriented electrical steel sheet, comprising:

a chemical composition represented by, in mass %,

Si: 2.0% to 5.0%,

Mn: 0.03% to 0.12%,

Cu: 0.60% to 1.00%,

Sb or Sn, or both thereof: 0.000% to 0.3% in total,

Cr: 0% to 0.3%,

P: 0% to 0.5%,

Ni: 0% to 1%, and the balance: Fe and impurities, wherein an L-direction average diameter of crystal grains observed on a surface of the steel sheet in an L direction parallel to a rolling direction is equal to or more than 3.6 times a C-direction average diameter in a C direction vertical to the rolling direction.

TABLE 8

| SAMPLE No. | STEEL TYPE | MAGNETIC STIRRING: RATIO OF SOLIDIFIED SHELL THICKNESS (%) | HOT ROLLING: FINISHING TEMPERATURE OF ROUGH ROLLING (° C.) | HOT ROLLING: WAITING TIME (SECOND) | HOT ROLLING: START TEMPERATURE OF FINISHING ROLLING (° C.) | HOT ROLLING: FINISHING TEMPERATURE OF FINISHING ROLLING (° C.) | COOLING: WAITING TIME (SECOND) | COOLING: COOLING RATE (° C./s) |
|---|---|---|---|---|---|---|---|---|
| D19 | D | 25 | 1220 | 27 | 1180 | 1090 | 0.7 | 100 |
| D20 | D | 25 | 1150 | 200 | 990 | 930 | 1.5 | 70 |
| D21 | D | 25 | 1150 | 150 | 1140 | 1000 | 12.0 | 70 |
| D22 | D | 25 | 1155 | 60 | 1170 | 1060 | 0.9 | 30 |
| D23 | D | 25 | 1140 | 180 | 1180 | 1060 | 0.8 | 100 |
| D24 | D | 25 | 1150 | 250 | 1160 | 1060 | 0.5 | 100 |

| SAMPLE No. | COILING TEMPERATURE (° C.) | HOT-ROLLED STEEL SHEET PRECIPITATE | GRAIN-ORIENTED ELECTRICAL STEEL SHEET: GRAIN DIAMETER RATIO | GRAIN-ORIENTED ELECTRICAL STEEL SHEET: B8 (T) | NOTE |
|---|---|---|---|---|---|
| D19 | 550 | MnS, $Cu_2S$ | 1.6 | 1.889 | COMPARATIVE EXAMPLE |
| D20 | 550 | MnS, $Cu_2S$ | 1.6 | 1.873 | COMPARATIVE EXAMPLE |
| D21 | 550 | MnS, $Cu_2S$ | 1.7 | 1.902 | COMPARATIVE EXAMPLE |
| D22 | 550 | MnS, $Cu_2S$ | 2.1 | 1.908 | COMPARATIVE EXAMPLE |
| D23 | 750 | MnS, $Cu_2S$ | 1.5 | 1.874 | COMPARATIVE EXAMPLE |
| D24 | 550 | MnS | 3.5 | 1.943 | INVENTION EXAMPLE |

2. A manufacturing method of the grain-oriented electrical steel sheet according to claim 1, comprising:

obtaining a slab by continuous casting a molten steel;

obtaining a hot-rolled steel sheet by hot rolling the slab heated in a temperature zone of 1300° C. to 1490° C.;

coiling the hot-rolled steel sheet in a temperature zone of 600° C. or less;

annealing the hot-rolled steel sheet;

after the hot-rolled sheet annealing, obtaining a cold-rolled steel sheet by cold rolling;

decarburization annealing the cold-rolled steel sheet; and after the decarburization annealing, coating an annealing separating agent containing MgO and finish annealing, wherein the hot rolling comprises rough rolling with a finishing temperature of 1200° C. or less and finish rolling with a start temperature of 1000° C. or more and a finishing temperature of 950° C. to 1100° C., in the hot rolling, the finish rolling is started within 300 seconds after start of the rough rolling, cooling at a cooling rate of 50° C/second or more is started within 10 seconds after finish of the finish rolling, a holding temperature of the hot-rolled sheet annealing is 950° C. to (Tf +100)° C. when the finishing temperature of the finish rolling is Tf, and the molten steel comprises a chemical composition represented by, in mass%, C: 0.015% to 0.10%, Si: 2.0% to 5.0%, Mn: 0.03% to 0.12%, acid-soluble Al: 0.010% to 0.065%, N: 0.0040% to 0.0100%, Cu: 0.60% to 1.00%, Cr: 0% to 0.3%, P: 0% to 0.5%, Ni: 0% to 1%, S or Se, or both thereof: 0.005% to 0.050% in total, Sb or Sn, or both thereof: 0.000% to 0.3% in total, Y, Te, La, Ce, Nd, Hf, Ta, Pb, or Bi, or any combination thereof: 0.0000% to 0.01% in total, and the balance: Fe and impurities.

3. The manufacturing method according to claim 2, wherein the casting comprises magnetically stirring the molten steel in a region where a thickness of one-side solidified shell is equal to or more than 25% of a thickness of the slab.

4. The manufacturing method according to claim 2, wherein the chemical composition satisfies: at least one of Sb or Sn, or both thereof: 0.003% to 0.3% in total and Y, Te, La, Ce, Nd, Hf, Ta, Pb, or Bi, or any combination thereof: 0.0005% to 0.01% in total.

* * * * *